US008888314B2

(12) United States Patent
Gill

(10) Patent No.: US 8,888,314 B2
(45) Date of Patent: Nov. 18, 2014

(54) LIGHTING APPARATUS USING LIGHT EMITTING DIODES

(75) Inventor: Jason Jae Gill, Seoul (KR)

(73) Assignee: Amoluxe Co., Ltd. (KR)

( * ) Notice: Subject to any disclaimer, the term of this patent is extended or adjusted under 35 U.S.C. 154(b) by 135 days.

(21) Appl. No.: 13/508,168

(22) PCT Filed: Nov. 3, 2010

(86) PCT No.: PCT/KR2010/007718

§ 371 (c)(1),
(2), (4) Date: May 4, 2012

(87) PCT Pub. No.: WO2011/055973

PCT Pub. Date: May 12, 2011

(65) Prior Publication Data

US 2012/0218757 A1 Aug. 30, 2012

(30) Foreign Application Priority Data

Nov. 5, 2009 (KR) ..... 10-2009-0106648
Feb. 4, 2010 (KR) ..... 10-2010-0010530

(51) Int. Cl.
*F21V 7/00* (2006.01)
*F21V 29/00* (2006.01)

(Continued)

(52) U.S. Cl.
CPC ..... *F21S 4/008* (2013.01); *F21V 15/011* (2013.01); *F21V 15/015* (2013.01);

(Continued)

(58) Field of Classification Search
CPC . F21V 29/004; F21V 29/006; F21V 29/2293; F21V 29/2237; F21V 29/2218; F21V 29/2262; F21V 29/2243; F21V 5/008; F21V 3/005; F21V 15/00; F21S 8/02; H01R 33/09; H05K 1/189
USPC ..... 362/218, 294, 373, 240, 238–239, 362/249.02, 374–375, 267
See application file for complete search history.

(56) References Cited

U.S. PATENT DOCUMENTS 7,152,996 B2 * 12/2006 Luk ..... 362/240
7,331,689 B2 * 2/2008 Chen ..... 362/240

(Continued)

FOREIGN PATENT DOCUMENTS

KR 10-0834973 5/2008
KR 1020080077758 8/2008

(Continued)

OTHER PUBLICATIONS

Machine translation of Park et al, KR 10-2008-0093527 A, published Oct. 22, 2008.*

(Continued)

*Primary Examiner* — Peggy Neils
*Assistant Examiner* — William N Harris
(74) *Attorney, Agent, or Firm* — Cantor Colburn LLP

(57) ABSTRACT

Provided is a lighting apparatus using light emitting diodes (LEDs) having a lateral heat radiation unit structure that can maximize heat radiation effect by employing an air vent structure causing atmospheric pressure difference between both side ends of an air circulation path. The lighting apparatus comprising a housing having a power supply accommodation space therein, a heat radiation unit that comprises an LED module accommodation groove that is installed on the top of the housing and having at least one inclined surface or mounting surface on which the LED module is mounted, and a number of fins that are formed on the outer circumferential surface of the LED module accommodation groove, an air circulation path that is lengthily formed between the housing and the heat radiation unit.

15 Claims, 14 Drawing Sheets

(51) Int. Cl.

| | |
|---|---|
| ***F21V 1/00*** | (2006.01) |
| ***F21V 11/00*** | (2006.01) |
| ***F21S 4/00*** | (2006.01) |
| ***F21V 21/00*** | (2006.01) |
| ***F21V 15/01*** | (2006.01) |
| ***F21V 15/015*** | (2006.01) |
| *F21V 7/20* | (2006.01) |
| *F21V 21/30* | (2006.01) |
| *F21Y 101/02* | (2006.01) |
| *F21Y 103/00* | (2006.01) |

(52) U.S. Cl.

CPC ..... *F21V 29/004* (2013.01); *F21V 29/2225* (2013.01); *F21V 29/2293* (2013.01); *F21V 7/20* (2013.01); *F21V 21/30* (2013.01); *F21V 29/2218* (2013.01); *F21V 29/2262* (2013.01); *F21Y 2101/02* (2013.01); *F21Y 2103/003* (2013.01)

USPC ..... 362/218; 362/294; 362/240; 362/249.02; 362/238; 362/373

(56) References Cited

U.S. PATENT DOCUMENTS

| | | | | |
|---|---|---|---|---|
| 7,654,703 | B2 * | 2/2010 | Kan et al. | 362/362 |
| 7,806,563 | B1 * | 10/2010 | Bruck et al. | 362/294 |
| 8,167,466 | B2 * | 5/2012 | Liu | 362/373 |
| 8,360,613 | B2 * | 1/2013 | Little, Jr. | 362/294 |
| 2010/0309662 | A1 * | 12/2010 | Zheng | 362/235 |

FOREIGN PATENT DOCUMENTS

| | | |
|---|---|---|
| KR | 10-2008-0093527 | 10/2008 |
| KR | 1020090081852 | 7/2009 |

OTHER PUBLICATIONS

Machine translation of Jeong et al, KR 10-0834973 B1, published Jun. 3, 2008.*

International Search Report—PCT/KR2010/007718 dated Jun. 1, 2011.

* cited by examiner

LIGHTING APPARATUS USING LIGHT EMITTING DIODES

TECHNICAL FIELD

The present invention relates to a lighting apparatus using light emitting diodes, and more particularly, to a lighting apparatus using light emitting diodes having a lateral heat radiation unit structure that can maximize a heat radiation effect by employing an air vent structure that achieve an air circulation using an atmospheric pressure difference between both sides of an air circulation path that is formed at a heat radiation housing structure.

BACKGROUND ART

A variety of conventional light sources such as fluorescent lamps, neon lamps and halogen lamps have preoccupied in the market of flood lamps, landscape lamps, and advertising lamps. However, light emitting diodes (LEDs) are in the spotlight of consumers as light sources in the lamp market in recent years. The reason why LEDs are getting the spotlight in the field of light sources is due to the device characteristics of the LEDs.

The conventional light sources that emit light using mercury are not environment-friendly, but the LEDs that emit light without using mercury are environment-friendly. In addition, the LEDs consume less electric power, to thereby save a maintenance cost. Further, the LEDs have the characteristics of longer life expectancy, more excellent durability, and stronger solidity than the conventional light sources.

In addition, the LEDs are gradually getting better in the electrical features of brightness and luminous efficiency. The LEDs are also driven at low voltage, to thus cause no risk of electric shock. As a result, the LEDs are being widely used with increasing speed. In particular, the LEDs are increasingly applied in the illumination field of buildings and landscapes due to an easy applications and brilliant lighting effects of the LEDs.

Considering these points of view, lighting apparatuses using light emitting diodes (LEDs) have been recently proposed as light sources. Light emitting diodes of low power consumption and with high brightness have been developed due to the technological development, and have been gradually spread in use. In the case of the high brightness light emitting diodes, light rays that are emitted from the high brightness light emitting diodes have stronger candle power. Accordingly, a light emitting diode chip containing a number of light emitting diodes is packaged so that light rays that are emitted from the light emitting diode chip are dispersed to irradiate a wider area. As a result, it is possible to use the light emitting diode chip whose light emitting ranges are divided into for example, 12° lens, 25° lens, 30° lens, 45° lens, reflector and so on.

The conventional LED lighting apparatus using these LEDs includes: a bar-shaped housing with a certain length; a printed circuit board (PCB) of a certain length that is installed in the inside of the housing; a number of light emitting diodes that are installed on the printed circuit board; and an electric power supply that supplies electric power with the LEDs.

The conventional bar-shaped LED lighting apparatus is disclosed as an LED landscape lighting apparatus in Korean Patent No. 10-0834973 in which only a number of bar-shaped lighting units are used with no separate lighting structure, to thereby perform a lighting situation of a bent state, and the number of the bar-shaped lighting units can be easily installed on stepped walls of a building.

The LED landscape lighting apparatus includes: a connecting member body having a certain length; a connecting member on both sides of which circular protrusions are respectively formed along the lengthy direction of the connecting member body; a number of lighting units each of which has a certain length, and both sides of which are respectively fitted into the protrusions of the connecting member so as to be rotated; and a number of light emitting modules that are respectively disposed in the lighting units and receive electric power from an external power source to thus emit light.

However, the LED landscape lighting apparatus has a problem of having no effective heat radiation because the light emitting module including a light emitting diode, a printed circuit board (PCB), and a controller is disposed in the unit body of the lighting unit, and end covers are combined on both sides of the unit body in order to protect the light emitting module, with a result that the inner portion of the unit body is maintained to be in a sealed state.

In other words, the LED landscape lighting apparatus has the difficulty in efficiently diffusing heat emitted from a number of high brightness light emitting diodes to the outside. As a result, the LED landscape lighting apparatus may cause problems that degrade light emission efficiency by the heat, as well as that damages parts of the LED landscape lighting apparatus.

In addition, Korean Patent No. 10-0903305 discloses a fluorescent lamp type LED lighting apparatus in which a printed circuit board (PCB) playing a role of an electric power source is housed in the inside of a rectangular vessel-shaped main body on the side of which a number of heat radiation fins are formed, both sides of the main body are sealingly combined by brackets, a bar-shaped LED and lens portion is mounted in an LED accommodation portion that is formed at the upper side of the main body, and a cover that is formed in the form of covering the LED and lens portion in order to protect the LED and lens portion is combined at the uppermost side of the main body.

However, since the LED lighting apparatus disclosed in the Korean Patent No. 10-0903305 employs a structure of sealing the inner portion of the main body with the brackets, heat that is diffused downwards from the LED and lens portion is not effectively radiated.

Meanwhile, in a well-known bar-shaped flood lamp, light emitting diodes are mounted on metal printed circuit board located at upper part of heat radiation housing. A number of heat radiation fins are perpendicularly extended from the metal printed circuit board. However, such a heat radiation fin structure has a problem of decreasing a heat radiation effect. As described above, in the case that a power supply is set inside of the heat radiation unit, the heat radiation unit need to be sealed. Accordingly, heat that is generated in the inside of the unit may not be efficiently discharged out.

DISCLOSURE

Technical Problem

To overcome inconveniences of the conventional art as described above, it is an object of the present invention to provide a lighting apparatus using light emitting diodes, which has a lateral heat radiation structure in which a power supply is separately installed from heat radiation structure and simultaneously an air vent structure of making an air circulation using an atmospheric pressure difference between both side ends of an air circulation path is employed in the air circulation path that is formed at a heat radiation housing, to thereby maximize a heat radiation effect.

In addition, it is another object of the present invention to provide a lighting apparatus using light emitting diodes, which provides a dual heat radiation structure, in which heat radiation fins are formed in the lengthy direction on both side surfaces of the lighting apparatus to thereby increase surface areas for the heat radiation, and to simultaneously provide an air circulation path.

In addition, it is still another object of the present invention to provide a lighting apparatus using light emitting diodes, in which a number of light emitting diode modules are respectively used as a point power source and selectively arranged so as to implement a desired light distribution type, to thereby achieve a desired light distribution type.

In addition, it is still another object of the present invention to provide a lighting apparatus using light emitting diodes, in which an angle adjustment block on the surface of which a number of light emitting diode modules are mounted is additionally provided to thereby achieve a desired irradiation angle and to thus implement a variety of light distribution types easily.

Technical Solution

To achieve the objects, according to one aspect of the present invention, there is provided a lighting apparatus using light emitting diodes (LEDs), the lighting apparatus comprising:

a housing having a power supply accommodation space therein;

a heat radiation unit that comprises an LED module accommodation groove that is installed on the top of the housing and having at least one inclined surface or mounting surface on which the LED module is mounted, and a number of fins that are formed on the outer circumferential surface of the LED module accommodation groove;

a power supply that is installed in the power supply accommodation space of the housing;

an air circulation path that is lengthily formed between the housing and the heat radiation unit;

a pair of covers that are combined at both side ends of the housing and heat radiation unit, and on each of which an air vent hole that performs air circulation at both side ends of the air circulation path is respectively formed;

a number of the LED modules that are respectively mounted on the top of a metal printed circuit board (PCB) that is installed on the inclined surface or mounting surface of the LED module accommodation groove; and a light transmission plate that is combined on the top of the heat radiation unit and transmits light emitted from the LED modules.

According to another aspect of the present invention, there is provided a lighting apparatus using light emitting diodes (LEDs), the lighting apparatus comprising:

a rectangular vessel shaped housing;

a heat radiation unit that comprises an LED module accommodation groove that is installed on top of the housing, in which at least one inclined surface or mounting surface is formed, and that comprises a number of fins that are branched off bilaterally on both side surfaces and lower surface of the LED module accommodation groove and formed along the lengthy direction of the LED module accommodation groove;

a power supply that is installed in the inside of the housing;

an air circulation path that is lengthily formed between the housing and the heat radiation unit;

a pair of covers that are combined at both side ends of the housing and heat radiation unit, and on each of which an air vent hole that performs air circulation by generating an atmospheric pressure difference at both side ends of the air circulation path is respectively formed;

a number of the LED modules that are respectively mounted on top of a metal printed circuit board (PCB) that is installed on the inclined surface or mounting surface in the LED module accommodation groove; and a light transmission plate that is combined on top of the heat radiation unit to thus transmit light emitted from the LED modules.

Preferably but not necessarily, the pair of the covers comprises an entrance cover having an entrance air vent hole through which air is taken in, and an exit cover having an exit air vent hole through which air is discharged out.

Preferably but not necessarily, the exit air vent hole of the exit cover is formed of a hole smaller than the entrance air vent hole of the entrance cover, in order to generate an atmospheric pressure difference between both side ends of the air circulation path.

Preferably but not necessarily, the size of the exit air vent hole formed through the air circulation path gets smaller and smaller as it goes toward the exit cover.

Preferably but not necessarily, the LED module accommodation groove of the heat radiation unit is bilaterally symmetrical along the lengthy direction of the heat radiation unit.

Preferably but not necessarily, the LED module accommodation groove comprises two inclined surfaces on which LED modules are respectively mounted.

Preferably but not necessarily, the LED module accommodation groove of the heat radiation unit is bilaterally asymmetrical along the lengthy direction of the heat radiation unit.

Preferably but not necessarily, the LED module accommodation groove comprises a vertical surface, and an inclined surface on which LED modules are mounted.

Preferably but not necessarily, the lighting apparatus further comprises a reflector plate that reflects light irradiated from the LED module between the vertical surface and the inclined surface.

Preferably but not necessarily, the LED module accommodation groove comprises an inclined surface on which LED modules are mounted, and a reflection surface that reflects light irradiated from the LED modules.

Preferably but not necessarily, each of the LED modules adjusts a light distribution angle using an angle of the inclined surface.

Preferably but not necessarily, each of the LED modules adjusts a light distribution angle using an angle adjustment block that is installed on the inclined surface.

According to still another aspect of the present invention, there is provided a lighting apparatus using light emitting diodes (LEDs), the lighting apparatus comprising:

a rectangular vessel shaped housing;

a heat radiation unit that comprises an LED module accommodation groove that is detachably installed on top of the housing, in which a mounting surface is formed, and that comprises a number of mutually differently lengthy fins that are branched off bilaterally on both side surfaces and lower surface of the LED module accommodation groove and formed along the lengthy direction of the LED module accommodation groove;

a power supply that is installed in the inside of the housing;

an air circulation path that is lengthily formed at the central portion between the housing and the heat radiation unit when the housing and the heat radiation unit are combined with each other;

a pair of housing covers that are combined at both side ends of the housing;

a pair of heat radiation unit covers that are combined at both side ends of the heat radiation unit, to thereby seal the LED module accommodation groove;

a number of the LED modules that are respectively mounted on top of a metal printed circuit board (PCB) that is installed on the mounting surface of the LED module accommodation groove; and a light transmission plate that is combined on top of the heat radiation unit to thus seal the upper portion of the LED module accommodation groove and transmits light emitted from the LED modules.

Preferably but not necessarily, the light transmission plate is supported by a pair of glass caps and fixed by a fixing screw.

Preferably but not necessarily, the number of fins of the heat radiation unit has a profile whose middle portion is concave, respectively.

According to yet another aspect of the present invention, there is provided a lighting apparatus using light emitting diodes (LEDs), the lighting apparatus comprising:

a heat radiation unit that comprises an LED module accommodation groove that is detachably installed on top of a lighting lamp fixture, in which a mounting surface is formed, and that comprises a number of mutually differently lengthy fins that are branched off bilaterally on both side surfaces and lower surface of the LED module accommodation groove and formed along the lengthy direction of the LED module accommodation groove;

an air circulation path that is lengthily formed at the central portion between the lighting lamp fixture and the heat radiation unit when the lighting lamp fixture and the heat radiation unit are combined with each other;

a pair of heat radiation unit covers that are combined at both side ends of the heat radiation unit, to thereby seal the LED module accommodation groove;

a number of the LED modules that are respectively mounted on top of a metal printed circuit board (PCB) that is installed on the mounting surface of the LED module accommodation groove; and a light transmission plate that is combined on top of the heat radiation unit to thus seal the upper portion of the LED module accommodation groove and transmits light emitted from the LED modules.

Advantageous Effects

As described above, a lighting apparatus using light emitting diodes according to the present invention employs an air circulation path of making an air circulation using an atmospheric pressure difference between both side ends of the air circulation path that is lengthily formed at a central portion of a left-hand and right-hand heat radiation unit structure, to thereby maximize a heat radiation effect, when a bar-shaped flood lighting apparatus or a landscape lighting apparatus is made of a number of light emitting diodes (LEDs).

In addition, the lighting apparatus according to the present invention can maximize a heat radiation effect since a power supply is separately installed from a heat radiation unit or a heat radiation housing, and heat generated from the light emitting diodes and the power supply are simultaneously radiated through the air circulation path that is lengthily formed at the center of the housing and communicates with the outside.

Further, the lighting apparatus according to the present invention can make it easy to implement a variety of desired light distribution types of lighting apparatuses since a number of LED modules are mounted in an angle adjustment block so that the LEDs have a variety of angles, respectively.

In addition, the lighting apparatus according to the present invention provides a dual heat radiation structure, to thereby maximize a heat radiation effect, in which heat radiation fins are formed on both side surfaces of the lighting apparatus to thereby increase surface areas of the heat radiation fins, and to simultaneously provide an air circulation path.

DESCRIPTION OF DRAWINGS

The above and/or other aspects of the present invention will become apparent and more readily appreciated from the following description of the exemplary embodiments, taken in conjunction with the accompanying drawings in which.

BEST MODE

Hereinbelow, a lighting apparatus using light emitting diodes according to respective embodiments of the present invention will be described with reference to the accompanying drawings.

Figure 1:
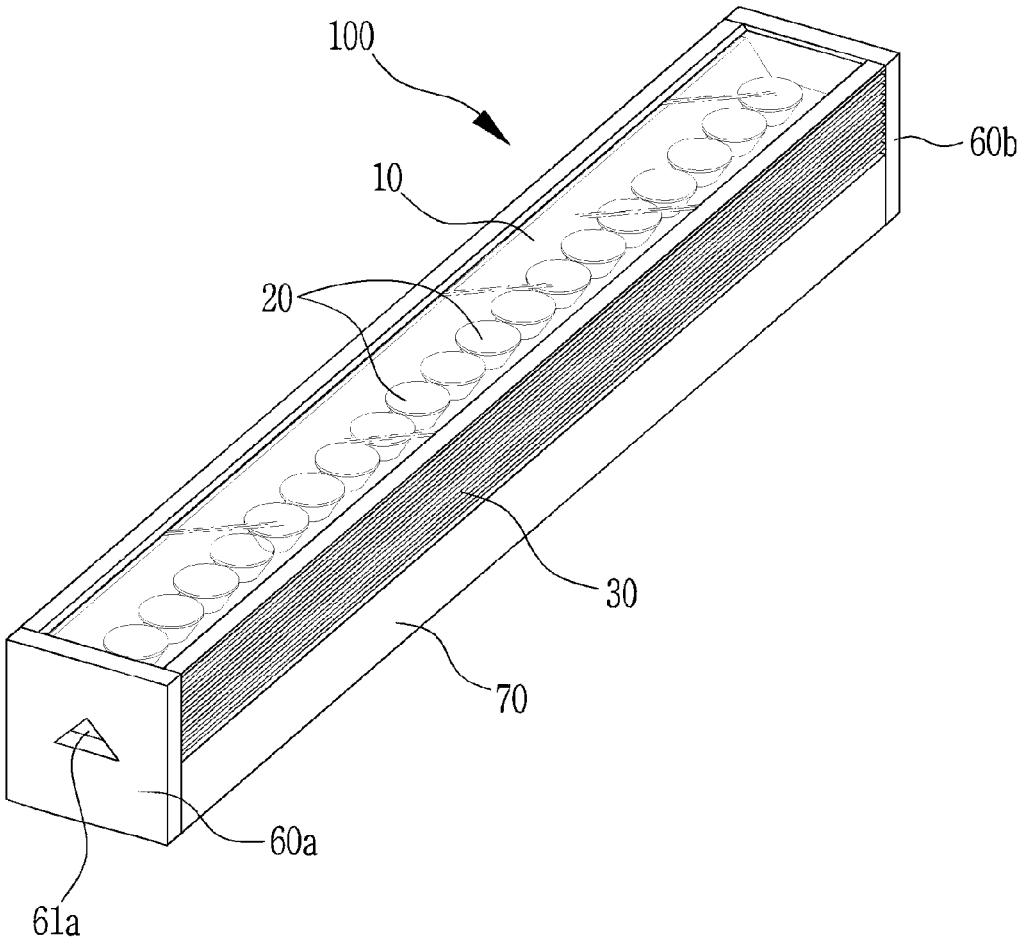
FIG. 1 is a perspective view showing a lighting apparatus using light emitting diodes according to a first embodiment of the present invention.
Figure 2:
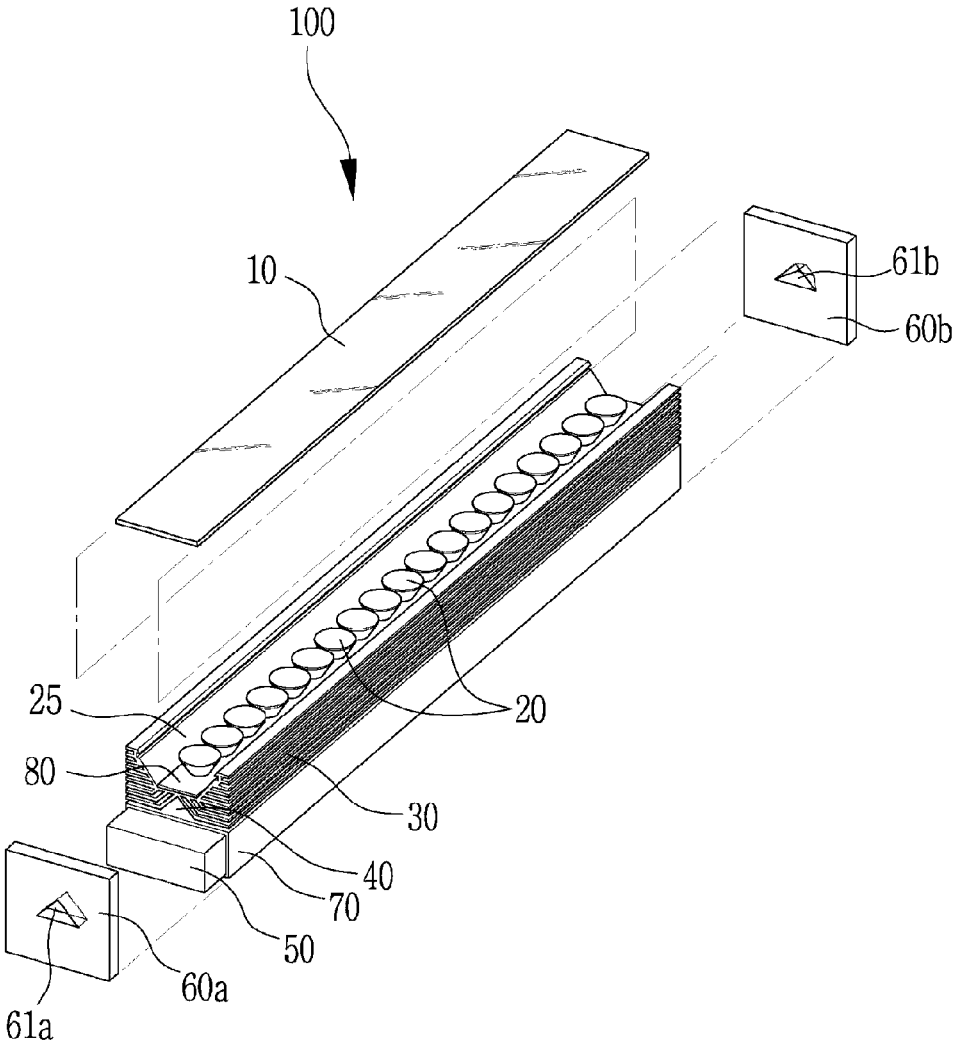
FIG. 2 is a disassembled perspective view showing the lighting apparatus using light emitting diodes of FIG. 1.
Figure 3:
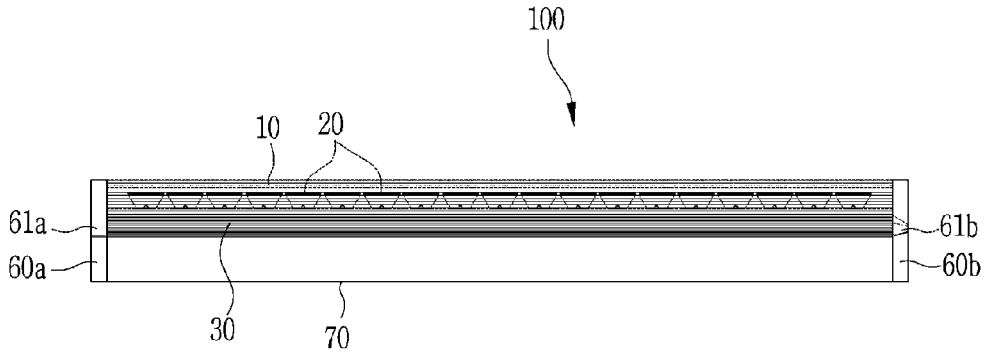
FIG. 3 is a side sectional view showing a partial section of the lighting apparatus using light emitting diodes of FIG. 1.

FIGS. 1 to 3 are a perspective view, a disassembled perspective view, and a side sectional view, respectively, which show a lighting apparatus using light emitting diodes according to a first embodiment of the present invention.

The lighting apparatus 100 using light emitting diodes according to the first embodiment of the present invention may be used as for example a landscape lighting apparatus that is fixedly installed on a floor or wall of a building so as to elegantly illuminate the external appearance of the building. However, the lighting apparatus 100 according to the present invention can be applied to an indoor or outdoor parking lot illumination device, an indoor illumination device, a tunnel illumination device, and a street lighting apparatus, as well as a landscape lighting apparatus.

Referring to FIGS. 1 to 3, the lighting apparatus 100 includes: a rectangular vessel shaped housing 70; a heat radiation unit 30 that forms an LED module accommodation groove on top of the housing 70 and that comprises a number of fins 30*a* to 30*n* that are symmetrically formed on inclined surfaces 25 formed on both side surfaces of the LED module accommodation groove; a power supply 50 that is separated from the heat radiation unit 30 and installed inside of the housing 70; an air circulation path 40 that is lengthily formed at the central portion between the housing 70 and the heat radiation unit 30; a pair of covers 60*a* and 60*b* that are combined at both side ends of the air circulation path 40, that is, at both sides of the housing 70 and the heat radiation unit 30, and on which air vent holes 61*a* and 61*b* that perform air circulation by generating an atmospheric pressure difference at both side ends of the air circulation path 40 are respectively formed; a number of LED modules 20 that are respectively mounted on top of a metal printed circuit board (PCB) 80 (of FIG. 4) that is fixedly installed on mounting surface 29*a* of the LED module accommodation groove of the heat radiation unit 30; and a light transmission plate 10 that transmits light emitted from the LED modules 20.

The housing 70 has a space to accommodate a power supply 50 therein. The heat radiation unit 30 is installed on top of the housing 70. The housing 70 is made of metal whose thermal conductivity is excellent, for example, aluminum or aluminum alloy, considering heat transfer and stiffness so as to transfer heat generated from the power supply 50 to the heat radiation unit 30, and can be made in an extruding or die-casting manner. The housing 70 can be transformed in various forms depending on a field where the lighting apparatus 100 is applied.

As shown in FIG. 1, the housing 70 is preferably formed of a rectangular vessel shape whose cross-sectional surface is rectangular so as to form the bar-shaped lighting apparatus 100, but can be formed in various shapes.

Figure 4:
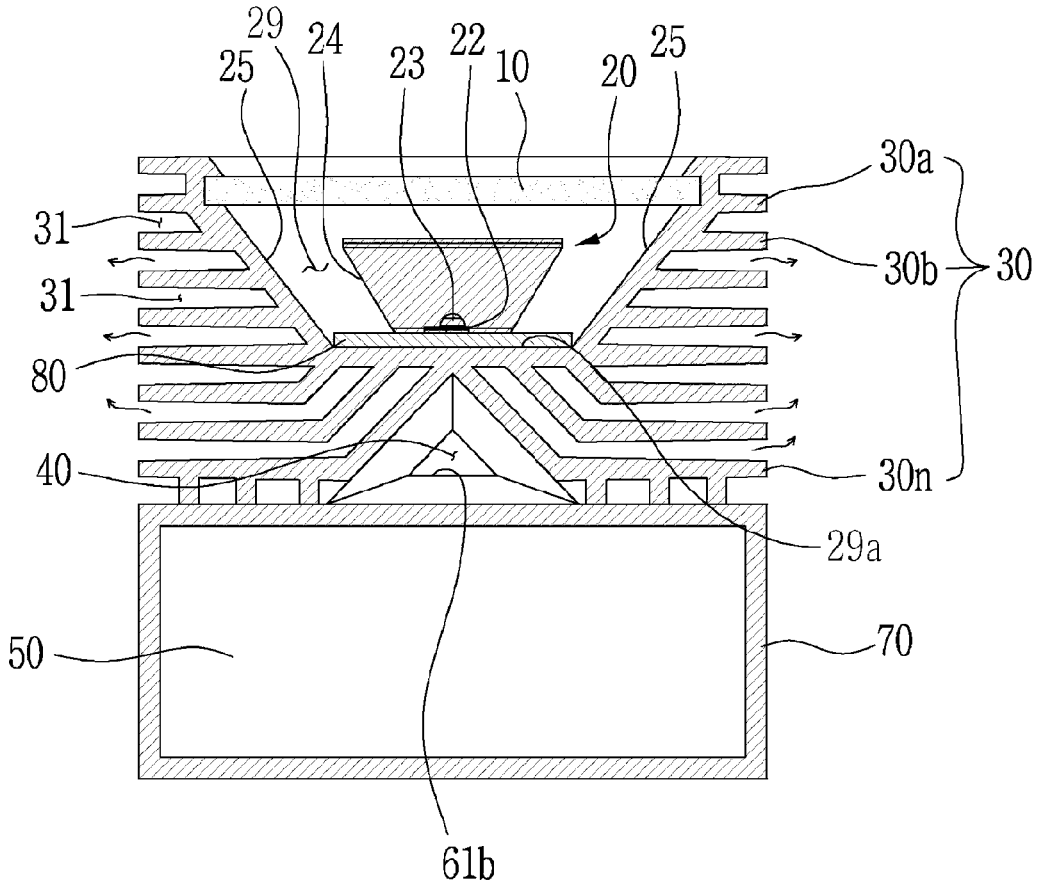
FIG. 4 is a cross-sectional view of the lighting apparatus using light emitting diodes of FIG. 1.

A number of the LED modules 20 are mounted on top of a metal printed circuit board (PCB) 80 of FIG. 4 that is fixed in the LED module accommodation groove that is formed at the central portion of the upper surface of the heat radiation unit 30, and are fixedly arranged in a row.

In this case, as shown in FIG. 4, inclined surfaces 25 that are formed at both sides of the LED module accommodation groove on the mounting surface of which the metal PCB 80 is mounted, contact the heat radiation fins 30*a* to 30*n* that is branched off in a left and right symmetry around the LED modules 20 in order to radiate heat emitted from the LED modules 20. Accordingly, the inclined surfaces 25 play a role of heat sinks, and simultaneously a role of reflection plates that reflect light emitted from the LED modules 20 toward the light transmission plate 10.

Figure 7:
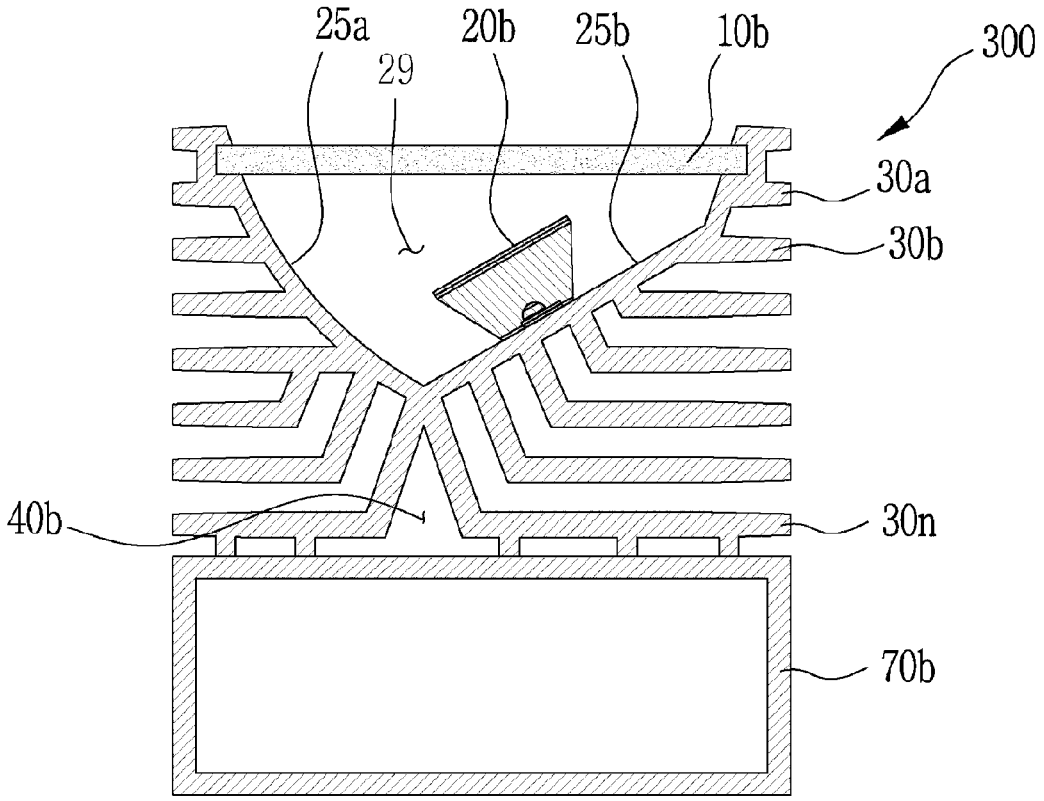
FIG. 7 is a cross-sectional view of FIG. 6.

Meanwhile, the metal PCB 80 is preferably made of a plate material having a high thermal conductivity, for example, aluminum, copper, iron or their alloys, and may be fixed on one of the inclined surfaces 25 using a small piece as shown in FIG. 7.

Meanwhile, the light transmission plate 10 is slidably installed in grooves formed in an opening portion of the heat radiation unit 30, to thus prevent foreign matters or water from flowing into the LED module accommodation groove of the heat radiation unit 30, and is made of transparent or translucent glass or a synthetic resin material.

Meanwhile, the air circulation path 40 that is lengthily formed at the central portion between the housing 70 and the heat radiation unit 30 communicates from an entrance air vent hole 61*a* formed on an entrance cover 60*a* in one side of the air circulation path 40, and communicates from an exist air vent hole 61*b* formed on an exit cover 60*b* in the other side of the air circulation path 40.

In other words, the entrance air vent hole 61*a* that is formed of a triangular hole formed at a substantially central portion of the entrance cover 60*a* communicates from the air circulation path 40. Likewise, the exit air vent hole 61*b* that is formed of a triangular hole formed at a substantially central portion of the exit cover 60*b* communicates from the air circulation path 40. The air circulation path 40 is formed to have an air vent structure in a manner that size of a triangular hole of the exit air vent hole 61*b* gets smaller and smaller as it goes toward the exit cover 60*b*.

In other words, the air circulation path 40 has a structure that the hole sizes of the air vent holes 61*a* and 61*b* formed at both sides thereof are differently formed to thus generate an atmospheric pressure difference between both side ends of the entrance cover 60*a* and the exit cover 60*b*, and make the internal air flow by convection in one direction so as to be discharged out to the outside easily. As a result, external air is introduced into the air circulation path 40, to thus cool the heat radiation unit 30 that dissipate heat generated from a number of the LED modules 20.

FIG. 4 is a cross-sectional view of the lighting apparatus using light emitting diodes according to the first embodiment of the present invention.

Referring to FIG. 4, each of the number of the LED modules 20 includes an LED chip 22, a first lens 23 and a second lens 24 that are formed on the metal PCB 80. In this case, the second lens 24 may be removed as necessary.

Light that is emitted by driving the LED chip 22 passes through the first lens 23 and the second lens 24 so as to be diffused and then transmits through the light transmission plate 10 so as to be radiated.

In this case, heat that is emitted by driving the LED chip 22 is radiated through a number of fins 30*a* to 30*n* that are bilaterally from left and right inclined surfaces 25 that form the LED module accommodation groove 29 of the heat radiation unit 30.

Here, inclined surfaces 25 are formed around the LED module accommodation groove 29 in which the LED modules 20 are accommodated in the heat radiation unit 30, and a number of fins 30*a* to 30*n* are branched off in a left and right symmetry from the left and right inclined surfaces 25 and the lower surface of the LED module accommodation groove 29, to then be laterally arranged lengthily on both side surfaces of the upper portion of the housing 70. The heat radiation unit 30 is formed to have a lateral heat radiation structure, to thereby make air flow by convection through a number of spaces 31 that are formed between the number of the fins 30*a* to 30*n* to then be cooled by air convection of the internal air circulation path 40 that is formed between the heat radiation unit 30 and the housing 70. In addition, both sides of each of the number of the fins 30*a* to 30*n* of FIG. 4 are horizontally formed, but each of the number of the fins 30*a* to 30*n* is preferably formed to have a rain water drainage structure that each of the number of the fins 30*a* to 30*n* is inclined downwards as it goes to the outer side of both the sides of each of the number of the fins 30*a* to 30*n*.

The air circulation path 40 is formed to have a triangular hole therethrough so that size of the triangular hole of the exit air vent hole 61*b* gets smaller and smaller as it goes toward the exit cover 60*b*. Accordingly, a cooling efficiency of the fins 30*n* that are disposed at the lowest side of the LED module accommodation groove 29 is increased by air convection due to an atmospheric pressure difference formed between both ends of the air circulation path 40.

Thus, heat generated from the LED modules 20 are primarily radiated directly by the laterally branched-off multiple fins 30*a* to 30*n*, and secondarily radiated by the fins 30*n* that are disposed at the lowest side of the heat radiation unit 30 and are cooled by air convection of the air circulation path 40, to thus maximize the heat radiation efficiency of the heat radiation unit 30.

In addition, the air circulation path 40 and the heat radiation unit 30 have structures that are respectively exposed to the outside. Accordingly, heat that is generated from the power supply 50 that is separated from the LED modules 20 and is inserted at the lower portion of the housing 70 is also radiated by the air circulation path 40 and the heat radiation unit 30.

Figure 5:
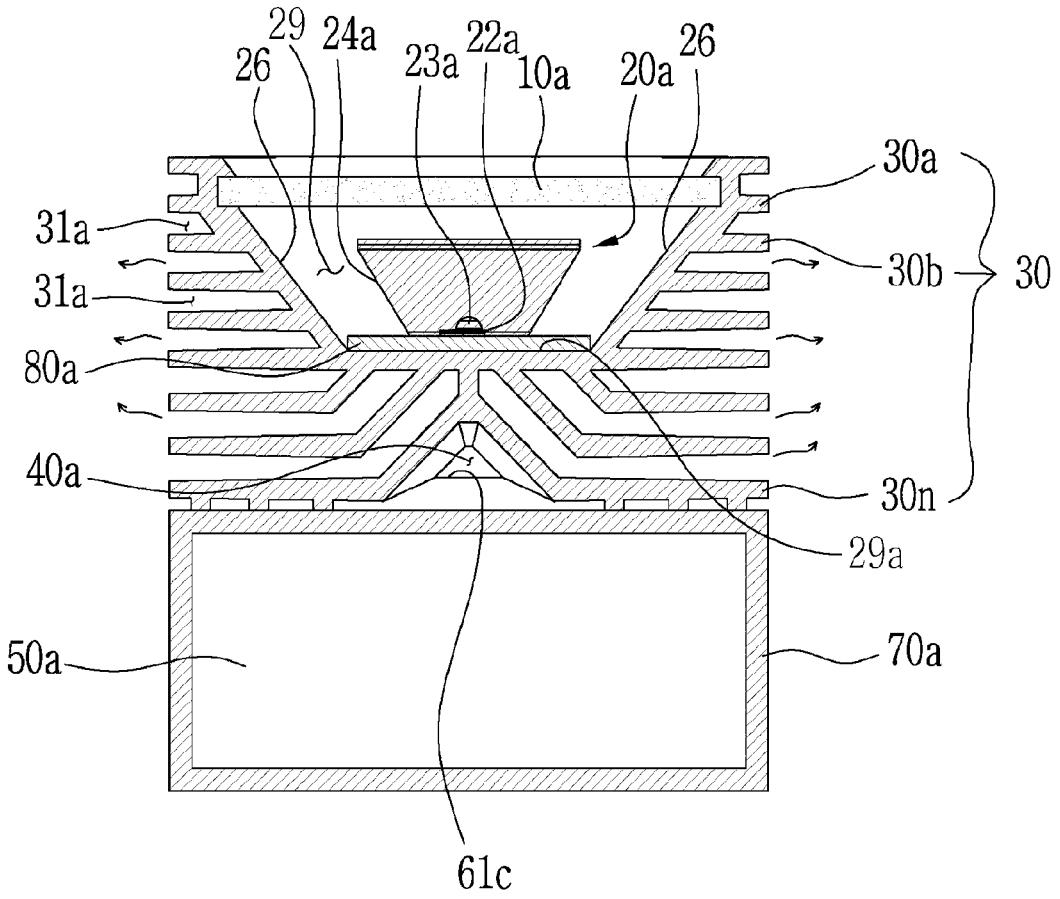
FIG. 5 is a cross-sectional view showing a variation of the lighting apparatus using light emitting diodes of FIG. 1.

FIG. 5 is a cross-sectional view showing a variation of the lighting apparatus using light emitting diodes according to the first embodiment of the present invention.

Referring to FIG. 5, each of the number of the LED modules 20*a* includes an LED chip 22*a*, a first lens 23*a* and a second lens 24*a* that are formed on the metal PCB 80*a*.

According to a difference between the first embodiment of the present invention and the variation of the first embodiment thereof, a number of fins 30*a* to 30*n* that are extended from inclined surfaces 26 that form an LED module accommodation groove 29 in a heat radiation unit 30 are branched off in a left and right symmetry around LED modules 20*a*, but a cross-sectional shape of an air circulation path 40*a* is a trapezoidal shape instead of the triangular shape, due to the heat radiation unit 30 that is disposed at the lower portion of a metal PCB 80*a*. Likewise even in the case of the variation of the first embodiment of the present invention, size of the trapezoidal hole formed through the air circulation path 40*a* gets smaller and smaller as it goes toward the exit air vent hole 61*c*. Accordingly, a cooling efficiency of the heat radiation unit 30 is increased by air convection due to an atmospheric pressure difference formed between both ends of the air circulation path 40*a*.

As shown in FIG. 4, the LED modules are mounted on the mounting surfaces 29*a* in the LED module accommodation groove 29, however, the LED modules can be mounted on the inclined surfaces 25 in the LED module accommodation groove 29.

Figure 6:
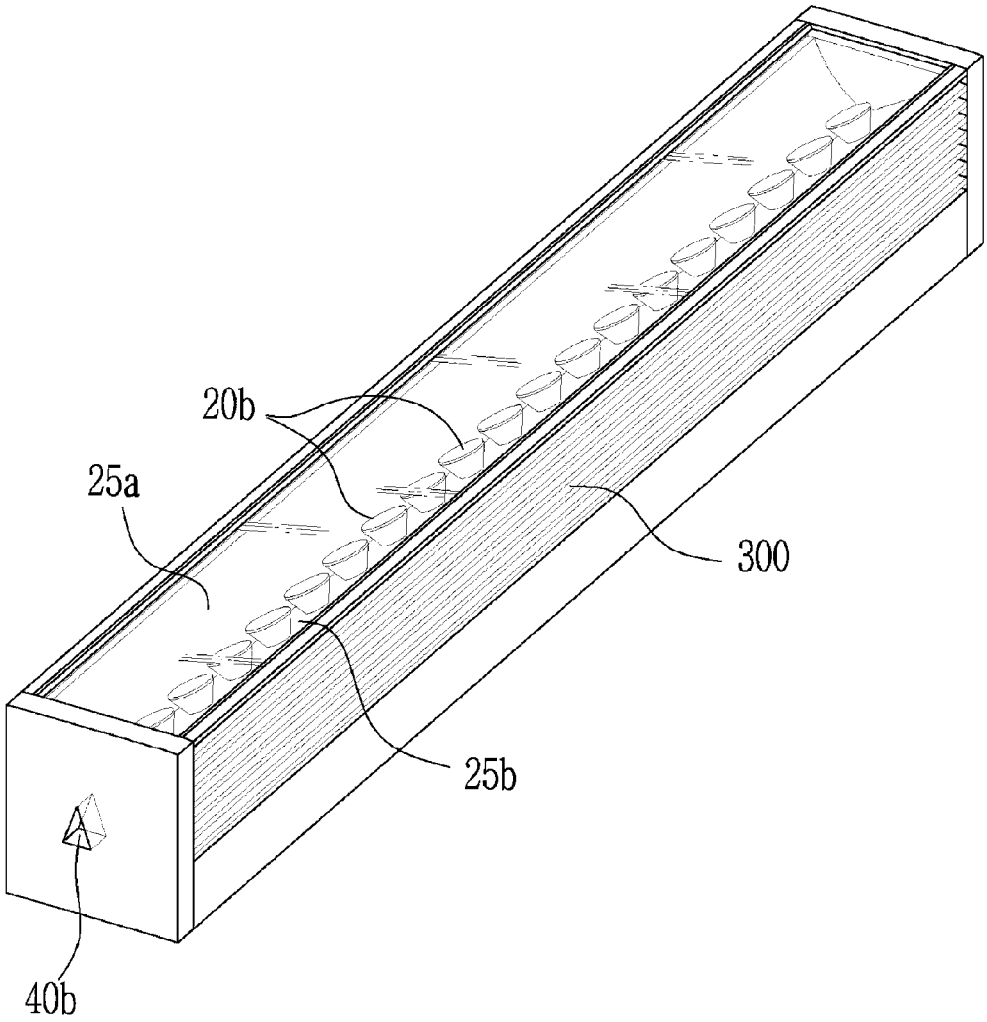
FIG. 6 is a perspective view showing a lighting apparatus using light emitting diodes according to a second embodiment of the present invention.

FIG. 6 is a perspective view showing a lighting apparatus using light emitting diodes according to a second embodiment of the present invention.

FIG. 7 is a cross-sectional view showing a lighting apparatus using light emitting diodes according to a second embodiment of the present invention.

Referring to FIGS. 6 and 7, according to a difference between the first and second embodiments of the present invention, the heat radiation unit 30 is formed of a left and right symmetrical structure in the first embodiment case, but a heat radiation unit 300 is formed of a left and right asymmetrical structure in the second embodiment case. In particular, an LED module accommodation groove 29 that accommodates LED modules 20*b* is formed of an inclined surface 25*a* of a curved shape and an inclined surface 25*b* of a planar shape. The LED modules 20*b* are mounted on the inclined surface 25*b* of the planar shape.

In this case, the inclined surface 25*a* of the curved shape acts as a reflective surface, and an inclination angle of the inclined surface 25*b* of the planar shape on which the LED modules 20*b* are mounted, is established according to a light distribution curve of a lighting apparatus. The function of an air circulation path 40*b* that is formed by the fin 30*n* that is disposed at the lowermost side of the heat radiation unit 300 and a housing 70*b* in the second embodiment of the present invention is the same as that of the first embodiment of the present invention.

Figure 8:
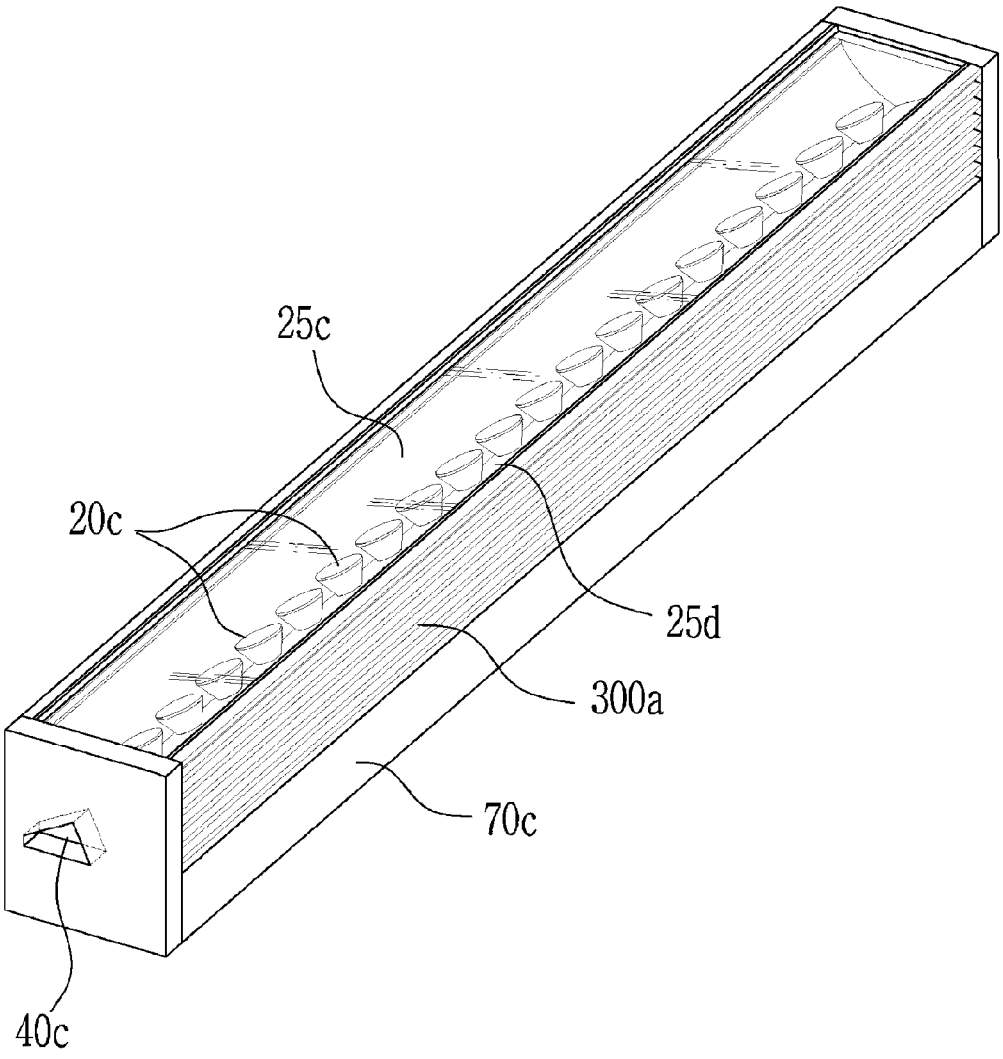
FIG. 8 is a perspective view showing a lighting apparatus using light emitting diodes according to a third embodiment of the present invention.
Figure 9:
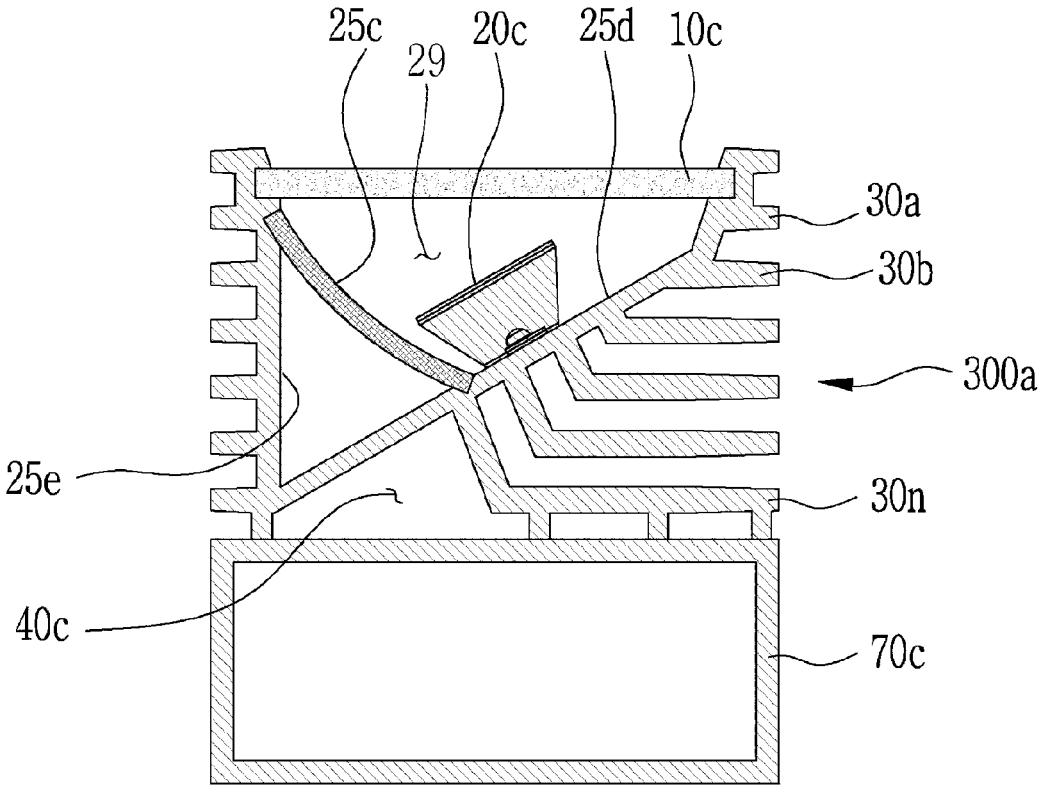
FIG. 9 is a cross-sectional view of FIG. 8.

FIG. 8 is a perspective view showing a lighting apparatus using light emitting diodes according to a third embodiment of the present invention. FIG. 9 is a cross-sectional view of FIG. 8.

Referring to FIGS. 8 and 9, an LED module accommodation groove 29 formed by a heat radiation unit 300*a* is formed of a vertical surface 25*e* at one side of the LED module accommodation groove 29, and an inclined surface 25*d* of a substantially 45 degrees from the horizontal plane at the other side thereof in which the vertical surface 25*e* faces the inclined surface 25*d*. LED modules 20*c* are mounted on the inclined surface 25*d*. Since the vertical surface 25*e* has low reflection efficiency, a reflective plate 25*c* of a curved shape is additionally disposed along a light reflection path of the LED modules 20*c* so that light emitted from the LED modules 20*c* can be reflected. Thus, a light distribution angle of the LED modules 20*c* can be adjusted on the basis of the angle of the inclined surface 25*d* and the reflective plate 25*c* that is disposed along the light reflection path of the LED modules 20*c*.

The function of an air circulation path 40*c* that is formed by the fin 30*n* that is disposed at the lowermost side of the heat radiation unit 300*a*, the inclined surface 25*d*, and a housing 70*c* in the third embodiment of the present invention is the same as that of the first embodiment of the present invention.

Figure 10:
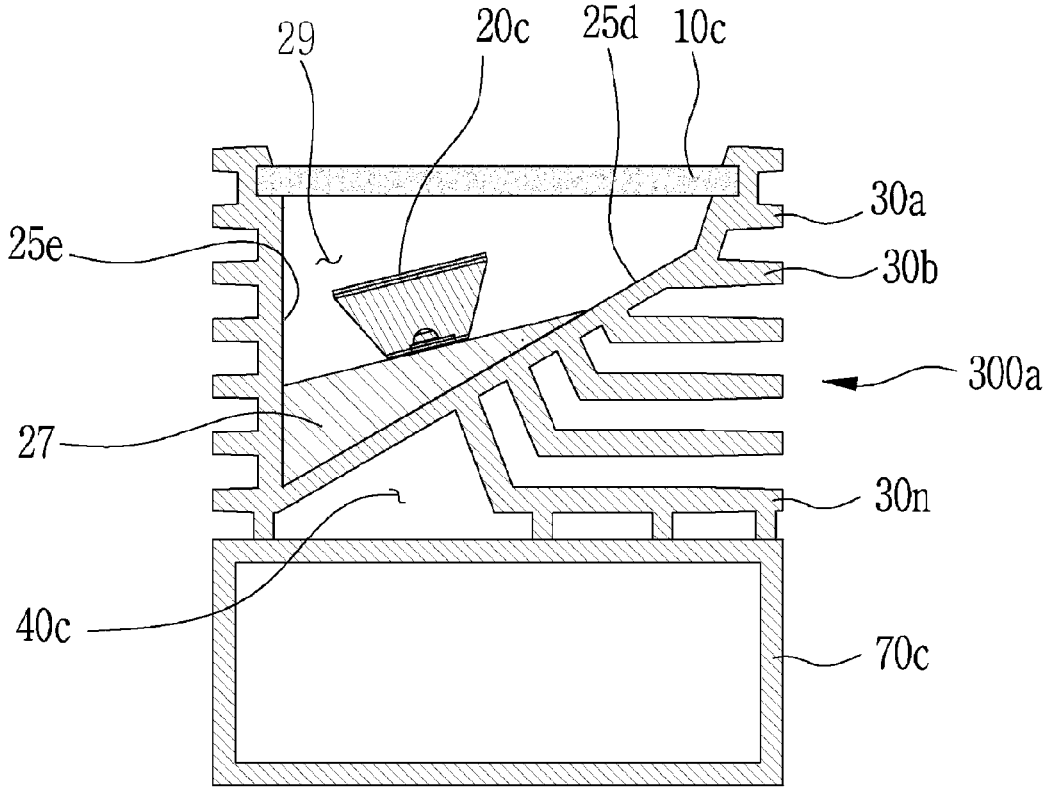
FIG. 10 is a cross-sectional view showing a variation of the lighting apparatus using light emitting diodes of FIG. 8.

FIG. 10 is a cross-sectional view showing a variation of the lighting apparatus using light emitting diodes of the third embodiment of the present invention.

A lighting apparatus of FIG. 10 includes an angle adjustment block 27 that is inserted between the vertical surface 25*e* and the inclined surface 25*d*, instead of the reflective plate 25*c* of the third embodiment of the present invention. The LED modules 20*c* are mounted on the angle adjustment block 27. In accordance with this variation, the light distribution angle of the LED modules 20*c* can be adjusted according to the inclination angle of the angle adjustment block 27. Thus, a number of angle adjustment blocks 27 whose inclined angles differ from each other are provided so as to be selectively used as necessary.

The angle adjustment block 27 is made of a metallic material that is the same as those of the heat radiation unit 300*a* and the housing 70, preferably, metal whose thermal conductivity is excellent, for example, aluminum or aluminum alloy, considering heat transfer and stiffness and can be made in an extruding or die-casting manner.

In addition, the angle adjustment block 27 is fixedly installed on the inclined surface using fixing pieces.

Figure 11:
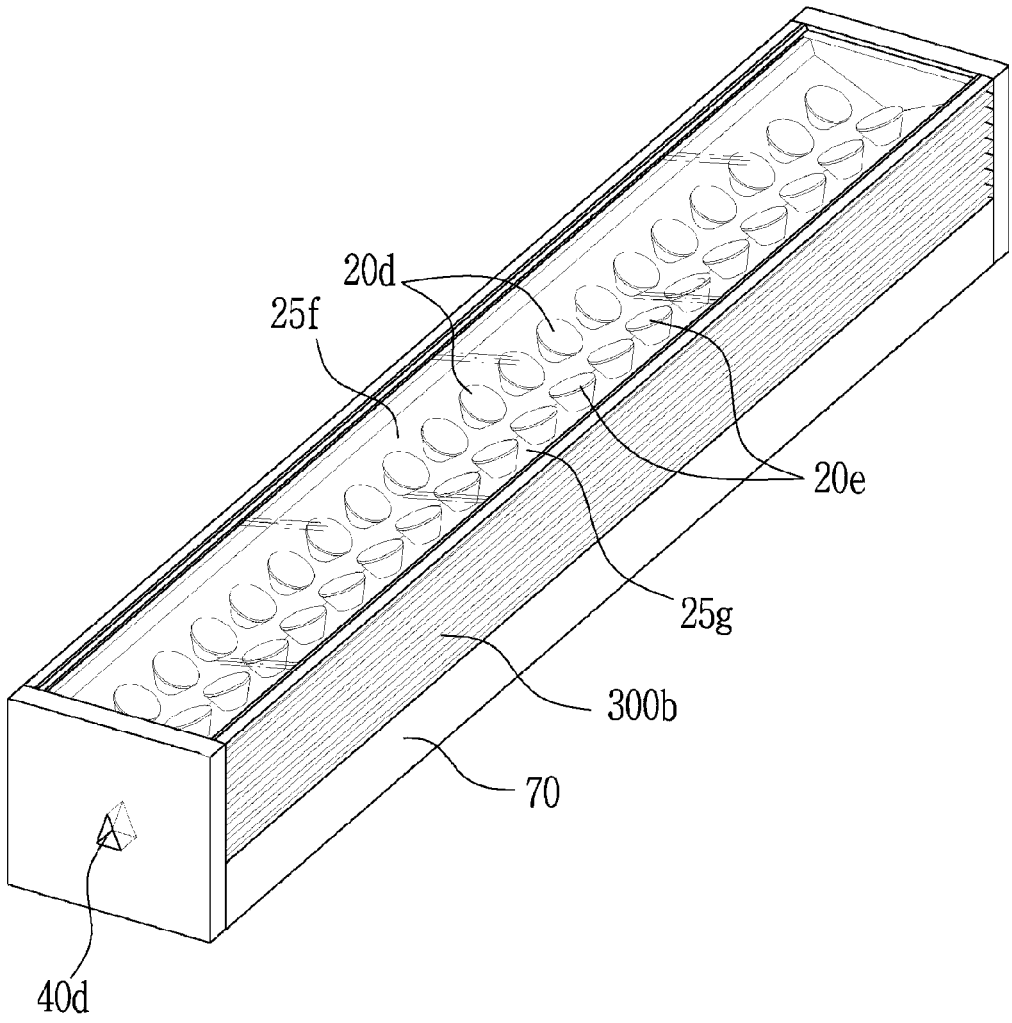
FIG. 11 is a perspective view showing a lighting apparatus using light emitting diodes according to a fourth embodiment of the present invention.
Figure 12:
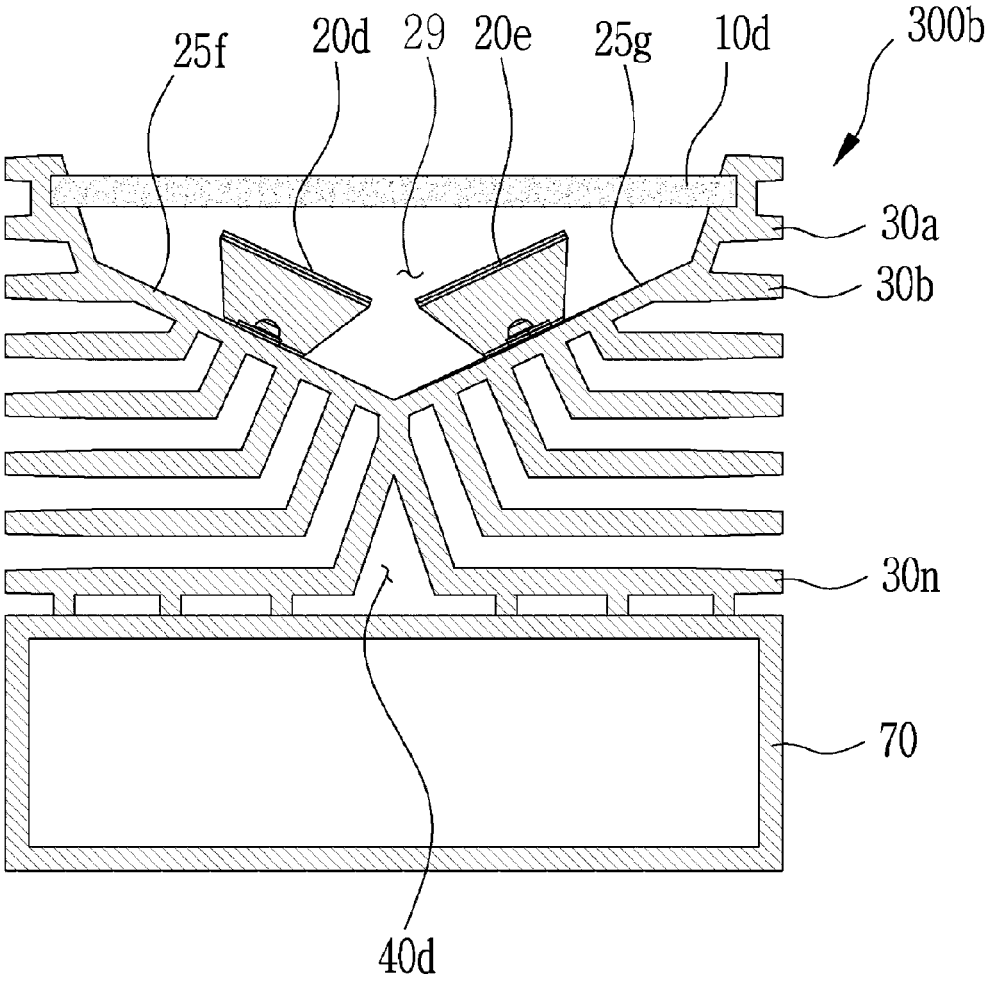
FIG. 12 is a cross-sectional view of FIG. 11.

FIG. 11 is a perspective view showing a lighting apparatus using light emitting diodes according to a fourth embodiment of the present invention. FIG. 12 is a cross-sectional view showing a lighting apparatus using light emitting diodes according to a fourth embodiment of the present invention.

Referring to FIG. 12, substantially V-shaped two inclined surfaces 25*f* and 25*g* are formed in an LED module accommodation groove 29 of a symmetrical heat radiation unit 300*b*. Two arrays of LED modules 20*d* and 20*e* are respectively mounted on metal PCBs of the inclined surfaces 25*f* and 25*g*. Light distribution angles of the two arrays of the LED modules 20*d* and 20*e* can be adjusted on the basis of an angle that is formed by the two opposing inclined surfaces 25*f* and 25*g*. In the case that the two arrays of the LED modules 20*d* and 20*e* are disposed on the left and right inclined surfaces 25*f* and 25*g*, respectively, as in the fourth embodiment of the present invention, the light distribution angles of a bat wing shape can be easily formed.

Figure 13:
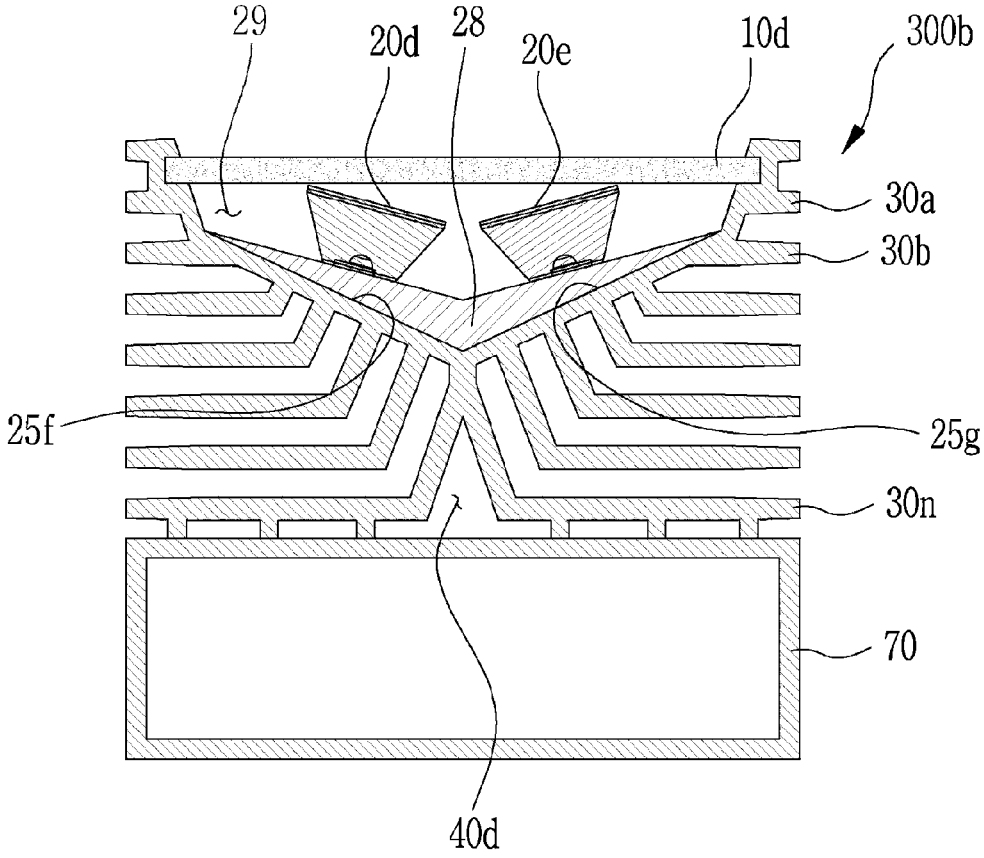
FIG. 13 is a cross-sectional view showing a variation of the lighting apparatus using light emitting diodes of FIG. 11.

FIG. 13 is a cross-sectional view showing a variation of the lighting apparatus using light emitting diodes of FIG. 11.

A lighting apparatus of FIG. 13 includes an angle adjustment block 28 on which opposing inclined surfaces are formed, instead of the opposing inclined surfaces 25*f* and 25*g* of the fourth embodiment of the present invention, in which two arrays of the LED modules 20*d* and 20*e* are respectively formed on top of the opposing inclined surfaces of the angle adjustment block 28. In accordance with this variation, the light distribution angles of the opposing LED modules 20*d* and 20*e* can be adjusted according to an angle formed by the inclined surfaces of the angle adjustment block 28.

Likewise, the angle adjustment block 28 is made of a metallic material that is the same as those of the heat radiation unit 300*b* and the housing 70, preferably, metal whose thermal conductivity is excellent, for example, aluminum or aluminum alloy, considering heat transfer and stiffness and can be made in an extruding or die-casting manner.

In addition, the angle adjustment block 28 is fixedly installed on the inclined surfaces using fixing pieces.

As described above, the angle of the inclined surfaces of the LED modules can be set up to have a variety of light distribution angles by desired angle adjustment blocks.

In addition, according to the present invention, the power supply 50 is separately installed from the heat radiation unit 300*b*, and simultaneously an air vent structure that performs air circulation by using an atmospheric pressure difference formed between both side ends of the air circulation path 40*d* is employed in the air circulation path 40*d* that is formed at the central portion between the heat radiation unit 30, 300*a*, or 300*b* and the housing 70, to thereby have a lateral heat radiation fin structure that can maximize a heat radiation effect.

Figure 14:
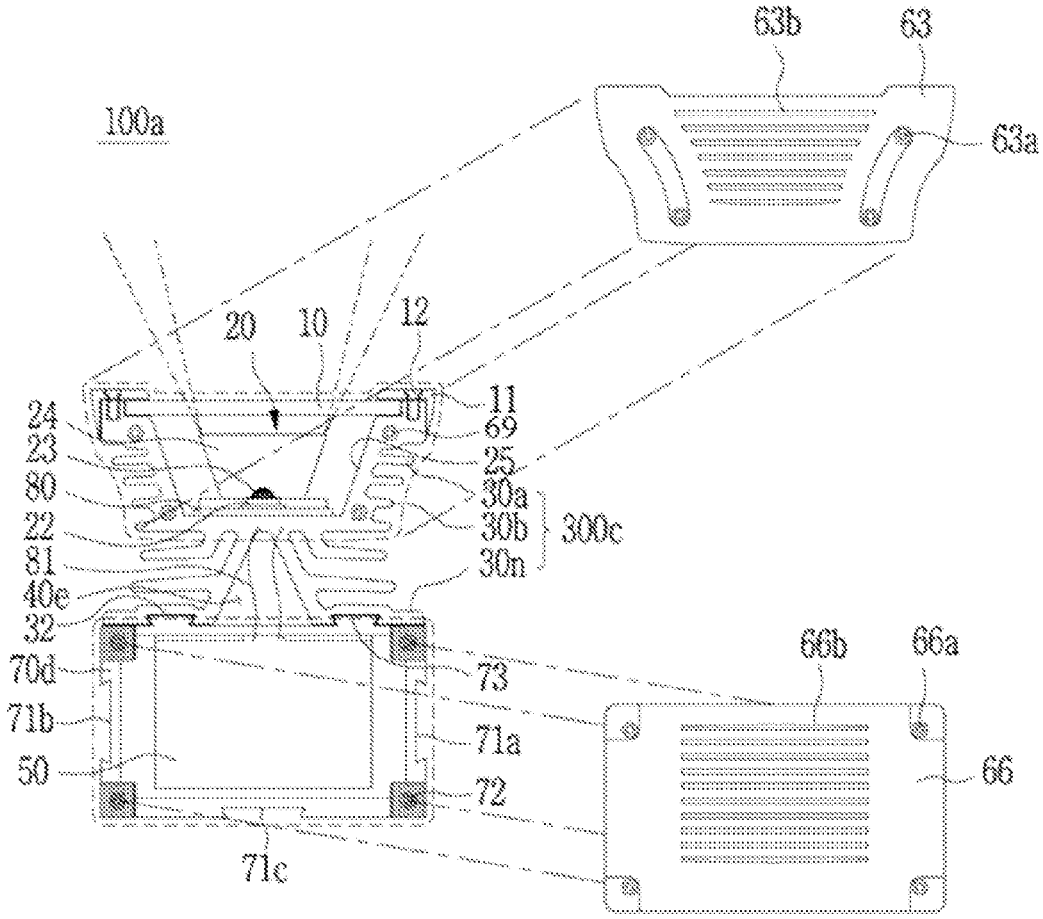
FIG. 14 is a perspective view showing a lighting apparatus using light emitting diodes according to a fifth embodiment of the present invention.

FIG. 14 is a perspective view showing a lighting apparatus using light emitting diodes according to a fifth embodiment of the present invention.

Referring to FIG. 14, the components of the fifth embodiment that are the same as those of the first embodiment are assigned with the same reference numerals as those of the first embodiment. Since the same components perform the same functions, the detailed description is omitted.

According to a difference between the first embodiment and the fifth embodiment, a pair of the covers 60*a* and 60*b* that cover the housing and the heat radiation unit are joined at both sides of the air circulation path 40, and the air vent holes 61*a* and 61*b* are formed so as to perform air circulation by generating an atmospheric pressure difference between both side ends of the air circulation path 40 in the first embodiment, but a lighting apparatus according to the fifth embodiment of the present invention includes two pairs of covers that are divided into a pair of housing covers 66 that are sealingly combined on both side surfaces of a housing 70*d* containing a power supply 50, and a pair of heat radiation unit covers 63 that are sealingly combined on both side surfaces of a heat radiation unit 300*c* containing LED modules 20.

As a result, no covers are combined on both side surfaces of an air circulation path 40*e* and natural convection is used in the fifth embodiment of the present invention without using an atmospheric pressure difference generated between both side ends of the air circulation path 40*e* that is applied in the in the first embodiment of the present invention.

In the case of the fifth embodiment of the present invention, the heat radiation unit 300*c* has been designed to raise a heat radiation efficiency of heat radiation fins 30*a* to 30*n* by modifying shape of the heat radiation unit 300*c*. That is, ends of a number of fins 30*a* to 30*n* are designed to match both side surfaces of the housing 70 in the first embodiment of the present invention, but a profile of the ends of a number of the fins 30*a* to 30*n* has been designed to make the middle part of the heat radiation unit 300*c* changed to form a concave shape in the fifth embodiment of the present invention.

In particular, in the case of the profile for the number of the fins 30*a* to 30*n* of the heat radiation unit 300*c* that is transformed according to the fifth embodiment of the present invention, a first group of fins that are disposed at the outside of inclined surfaces 25 are set to have an equal or similar length one another, and a second group of fins that are disposed at the lower surface of a metal PCB 80 are set to have an equal or similar length one another.

As a result, the number of fins 30*a* to 30*n* of the heat radiation unit 300*c* smoothly contact or heat-exchange with the outside air to thereby maximize the heat radiation effect.

Furthermore, in the case of the fifth embodiment of the present invention, a pair of coupling protrusions 73 that are formed on the upper surface of the housing 70, and a pair of coupling grooves 32 that are formed at the lower side of the fin 30*n* are slidably combined with each other between the heat radiation unit 300*c* and the housing 70*d*. That is, a coupling between the heat radiation unit 300*c* and the housing 70*d* has a detachable coupling structure.

If the pair of the coupling grooves 32 are coupled with the pair of the coupling protrusions 73, and thus the heat radiation unit 300*c* is coupled with the housing 70*d*, a space formed by a pair of fins 30*n* that are branched off symmetrically from the center of the lower surface of the LED modules 20 becomes an air circulation path 40*e*.

The air circulation path 40*e* plays a role of a path through which a cable 81 passes from a power supply 50 provided in the housing 70*d* to the LED modules 20 in order to supply electric power from the power supply 50 to the LED modules 20.

The light transmission plate 10 that is combined on the upper portion of the heat radiation unit 300*c* is supported by a pair of glass caps 11 and fixed using fixing screws 12.

Meanwhile, each of the pair of the heat radiation unit covers 63 includes embossed projections 63*b* that are formed on the outer surface thereof and four fixing holes 63*a* that are respectively formed at four corners thereof. Here, the four fixing holes 63*a* are disposed to communicate from four fixing holes 69 of the heat radiation unit 300*c* and are fixed using fixing screws (not shown).

Each of the pair of the housing covers 66 includes embossed projections 66*b* that are formed on the outer surface thereof and four fixing holes 66*a* that are respectively formed at four corners thereof. Here, the four fixing holes 66*a* are disposed to communicate from four fixing holes 72 of the housing 70*d* and are fixed using fixing screws (not shown). Thus, the heat radiation unit 300*c* and the housing 70*d* are encased by the covers 63 and 66, respectively, and the air circulation path 40*e* that is positioned at the central portion of the lighting apparatus is exposed to the outside, to thereby generate air convection to then maximize heat radiation efficiency.

In addition, coupling grooves 71*a*, 71*b*, and 71*c* are formed on both side surfaces and lower surface of the housing 70*d*, respectively.

Figure 15:
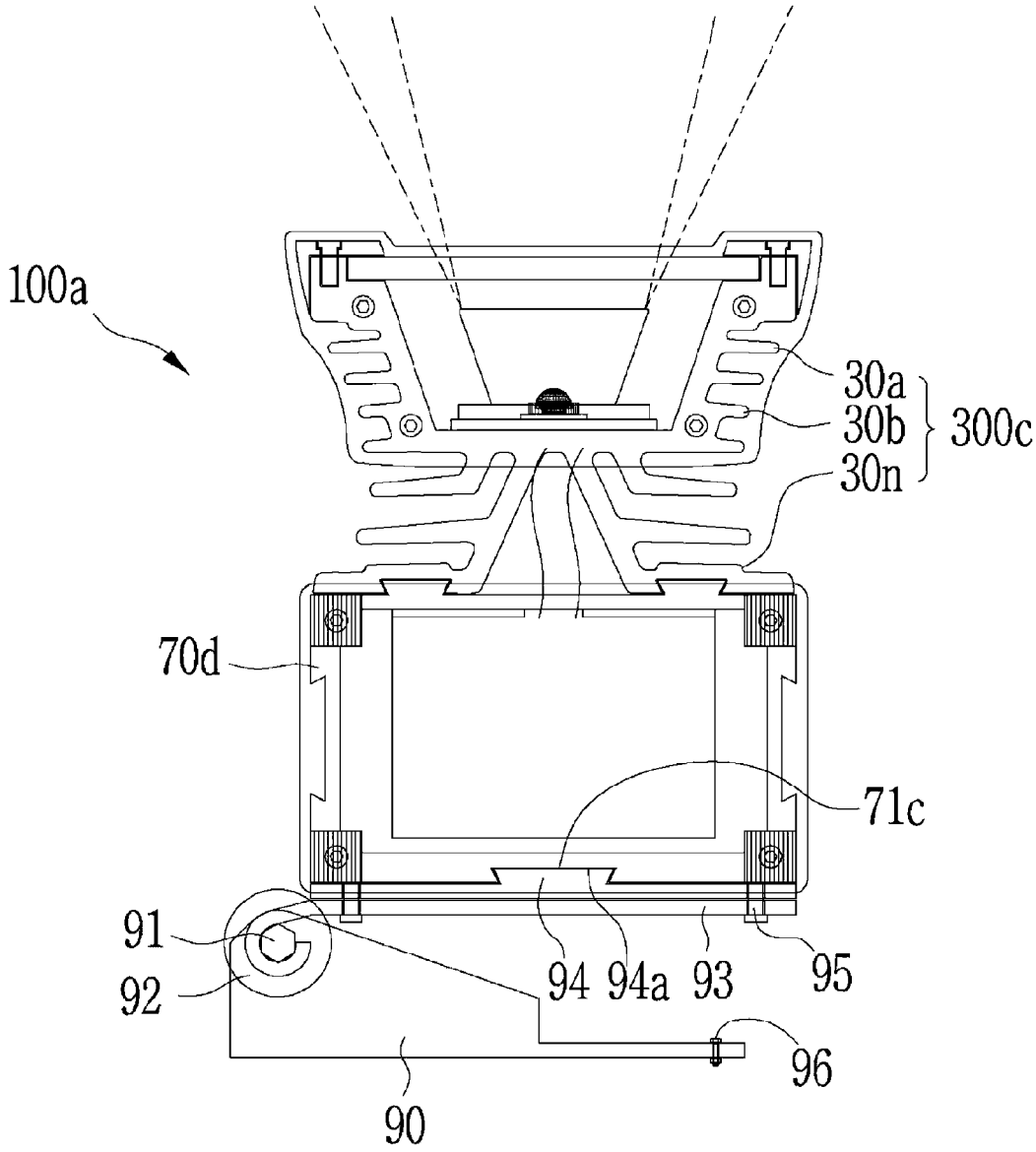
FIG. 15 is a cross-sectional view showing an installation example of FIG. 14.

FIG. 15 is a cross-sectional view showing an example of an installation fixture when a lighting apparatus according to a fifth embodiment of the present invention is used as a flood lighting apparatus.

Referring to FIG. 15, the lighting apparatus 100*a* is implemented so that a coupling protrusion 94*a* formed on a coupling plate 94 is coupled with a coupling groove 71*c* formed on the lower surface of the housing 70*d*, at a state where the heat radiation unit 300*c* and the housing 70*d* are combined with each other.

The coupling plate 94 is combined with a lower support bracket 93 by a pair of coupling screws 95, and one end of the lower support bracket 93 is wound and fixed on a longitudinal axis 91, to thereby maintain elasticity and establish an orientation angle. One side of the axis 91 is covered with a cover 92, and fixed to a fixed frame 90 that is formed at one side of the axis 91. The fixed frame 90 is fixedly installed by a frame fixing screw 96.

Figure 16:
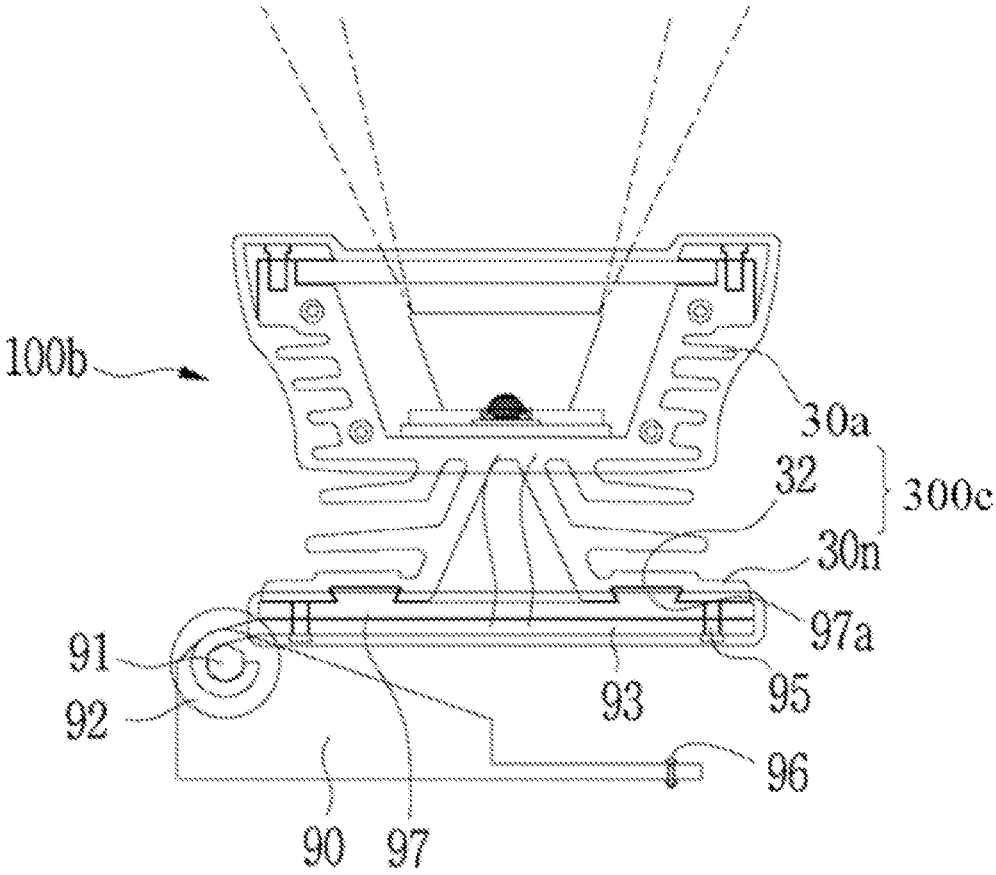
FIG. 16 is a cross-sectional view showing a variation of the installation example of FIG. 14.

FIG. 16 is a cross-sectional view showing a variation of an installation example from which a power supply has been removed, when a lighting apparatus according to the fifth embodiment of the present invention is used as a flood lighting apparatus.

Referring to FIG. 16, in the case that a power supply is separately provided, a lighting apparatus with no housing is implemented so that a pair of coupling protrusions 97*a* formed on a coupling plate 97 is coupled with a pair of coupling grooves 32 formed on the lower surface of the heat radiation unit 300*c*.

The coupling plate 97 is combined with a lower support bracket 93 by a pair of coupling screws 95, and the lower support bracket 93 is wound on a longitudinal axis 91, to thereby maintain elasticity and establish an angle. The axis 91 is covered with a cover 92, and fixed to one side of a fixed frame 90. The fixed frame 90 is fixedly installed by a frame fixing screw 96.

Even in the case of the first through fourth embodiments of the present invention, the housing and the heat radiation unit are detachably combined with each other by an uneven structure formed between the housing and the heat radiation unit, similarly to the case of the fifth embodiment of the present invention, and the covers of the heat radiation unit and the housing can be used so as to be detached from the heat radiation unit and the housing, respectively.

As mentioned above, although the present invention has been described in detail with respect to the limited embodiments and drawings but is not limited thereto. It is apparent to one who has an ordinary skill in the art that there may be a number of modifications and variations within the same technical spirit of the invention. It is natural that the modifications and variations belong to the following appended claims.

INDUSTRIAL APPLICABILITY

The lighting apparatus according to the present invention can be applied to a variety of light distribution types of building illumination flood lighting apparatuses, warning lighting apparatuses, road illumination street lighting apparatuses, indoor lighting apparatuses, a parking lot illumination lighting apparatuses, and so on.

The invention claimed is:

1. A lighting apparatus using light emitting diodes (LEDs), the lighting apparatus comprising:

a housing having a power supply accommodation space therein;

a heat radiation unit that comprises an LED module accommodation groove that is installed on a top of the housing and having at least one inclined surface or mounting surface on which an LED module is mounted, and a number of fins that are formed on an outer circumferential surface of the LED module accommodation groove;

a power supply that is installed in the power supply accommodation space of the housing;

an air circulation path that is lengthily formed between the housing and the heat radiation unit;

a pair of covers that are combined at both side ends of the housing and heat radiation unit, and on each of which an air vent hole that performs air circulation at both side ends of the air circulation path is respectively formed;

a number of the LED modules that are respectively mounted on a top of a metal printed circuit board (PCB) that is installed on the inclined surface or mounting surface of the LED module accommodation groove; and a light transmission plate that is combined on a top of the heat radiation unit and transmits light emitted from the LED modules, wherein the air circulation path has a cross-section being gradually smaller towards one of the air vent holes from the other one thereof, in order for a heated-up air inside the air circulation path to create directional flow of the heated-up air.

2. The lighting apparatus according to claim 1, wherein the LED module accommodation groove is bilaterally symmetrical along a lengthy direction of the heat radiation unit.

3. The lighting apparatus according to claim 2, wherein the LED module accommodation groove comprises two inclined surfaces on which LED modules are respectively mounted.

4. The lighting apparatus according to claim 1, wherein the LED module accommodation groove is bilaterally asymmetrical along a lengthy direction of the heat radiation unit.

5. The lighting apparatus according to claim 4, wherein the LED module accommodation groove comprises a vertical surface, and an inclined surface on which LED modules are mounted.

6. The lighting apparatus according to claim 5, further comprising a reflector plate formed between the vertical surface and the inclined surface for reflecting light irradiated from the LED modules.

7. The lighting apparatus according to claim 4, wherein the LED module accommodation groove comprises an inclined surface on which LED modules are mounted, and a reflection surface that reflects light irradiated from the LED modules.

8. The lighting apparatus according to claim 1, wherein each of the LED modules adjusts a light distribution angle using an angle adjustment block that is installed on the inclined surface.

9. The lighting apparatus according to claim 1, wherein the number of fins are branched off and extended from both side surfaces and a lower surface of the LED module accommodation groove.

10. The lighting apparatus according to claim 1, wherein the air circulation path is formed between a pair of fins disposed at a lowermost portion among the number of the fins and the upper surface of the housing.

11. The lighting apparatus according to claim 1, wherein the housing is in the form of a rectangular vessel.

12. The lighting apparatus according to claim 1, wherein the heat radiation unit is detachably installed on the top of the housing.

13. The lighting apparatus according to claim 1, wherein the light transmission plate is supported by a pair of glass caps and fixed by a fixing screw in order to seal the LED module accommodation groove.

14. The lighting apparatus according to claim 1, wherein the number of the fins of the heat radiation unit have a profile whose middle portion is concave, respectively.

15. A lighting apparatus using light emitting diodes (LEDs), the lighting apparatus comprising:

a heat radiation unit that comprises an LED module accommodation groove that is detachably installed on top of a lighting lamp fixture and on an upper side of which LED modules are respectively mounted, in which a mounting surface is formed, and that comprises a number of heat radiation fins that are branched off bilaterally on both side surfaces and lower surface of the LED module accommodation groove and extensively formed along a lengthy direction of the LED module accommodation groove;

a pair of covers that are combined at both side ends of the heat radiation unit, to thereby seal both side surfaces of the LED module accommodation groove;

a number of the LED modules that are respectively mounted on top of a metal printed circuit board (PCB) installed on the mounting surface of the LED module accommodation groove; and a light transmission plate that is combined on top of the heat radiation unit to thus seal the upper portion of the LED module accommodation groove and transmits light emitted from the LED modules, wherein an air circulation path is lengthily formed between the lighting lamp fixture and the heat radiation unit when the lighting lamp fixture and the heat radiation unit are combined with each other, and an air vent hole that performs air circulation is formed at both side ends of the air circulation path, and wherein the air circulation path has a cross-section being gradually smaller towards one of the air vent holes from the other one thereof, in order for a heated-up air inside the air circulation path to create directional flow of the heated-up air.

* * * * *